US006651981B2

(12) United States Patent
Grauzer et al.

(10) Patent No.: US 6,651,981 B2
(45) **Date of Patent: *Nov. 25, 2003**

(54) CARD SHUFFLING APPARATUS WITH INTEGRAL CARD DELIVERY

(75) Inventors: Attila Grauzer, Las Vegas, NV (US); Troy D. Nelson, Big Lake, MN (US); Paul K. Scheper, Eden Prairie, MN (US); James B. Stasson, Chanhassen, MN (US); Ronald R. Swanson, Plymouth, MN (US); Feraidoon Bourbour, Minneapolis, MN (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,502

(22) Filed: Sep. 28, 2001

(65) Prior Publication Data

US 2003/0075865 A1 Apr. 24, 2003

(51) Int. Cl.[7] ..... A63F 9/08

(52) U.S. Cl. ..... 273/149 R; 275/149 P; 275/309; 413/13

(58) Field of Search ..... 273/148 R, 309, 273/149 R, 149 P

(56) References Cited

U.S. PATENT DOCUMENTS

| | | | |
|---|---|---|---|
| 793,489 | A | 6/1905 | Williams |
| 2,001,220 | A | 5/1935 | Smith |
| 2,001,918 | A | 5/1935 | Nevius |
| 2,016,030 | A | 10/1935 | Woodruff et al. |
| 2,043,343 | A | 9/1936 | Warner |
| 2,778,644 | A | 1/1957 | Stephenson |
| 2,937,739 | A | 5/1960 | Levy |
| 2,950,005 | A | 8/1960 | MacDonald |
| 3,147,978 | A | 9/1964 | Sjöstrand |
| 3,235,741 | A | 2/1966 | Plaisance |

(List continued on next page.)

FOREIGN PATENT DOCUMENTS

WO WO 98/40136 9/1998

OTHER PUBLICATIONS

Scarne's Encyclopedia of Games by John Scarne, 1973, "Super Contract Bridge", p. 153.

*Primary Examiner*—John M Hotaling, II
(74) *Attorney, Agent, or Firm*—Mark A. Litman & Assoc. P.A

(57) ABSTRACT

A card shuffling device includes a top surface, a card receiving area for receiving an initial set of playing cards, a randomizing system for randomizing the initial set of playing cards, a collection surface in a card collection area for receiving randomized playing cards, the collection surface receiving cards positioned so that all cards collected are below the top surface of the device, and an elevator for raising the collection surface so that at least some randomized cards are elevated above the top surface of the device. An automatic card shuffler includes a microprocessor with memory, an infeed compartment for receiving cards to be randomized, a card moving mechanism for moving cards individually from the infeed compartment into a card mixing compartment, a card mixing compartment comprising a plurality of substantially vertical supports, an opening for the passage of cards from the infeed compartment, a moveable lower support surface, at least one stationary gripping arm, a lower edge proximate the opening, the gripping arm capable of suspending cards above the opening, and an elevator for raising and lowering the moveable support surface. A position of the elevator is randomly selected and the support surface is moved to the selected position, and after the gripping arm grasps at least one side of the cards, the elevator lowers, creating a space beneath the gripping arm, wherein a card is moved from the infeed compartment into the space, thereby randomizing the cards. A method of randomizing a group of cards utilizing the apparatus is disclosed.

69 Claims, 5 Drawing Sheets

U.S. PATENT DOCUMENTS 3,312,473 A 4/1967 Friedman et al.
3,690,670 A 9/1972 Cassady et al.
3,716,238 A 2/1973 Porter
3,897,954 A 8/1975 Erickson et al.
3,944,230 A 3/1976 Fineman
4,159,581 A 7/1979 Lichtenberg
4,232,861 A 11/1980 Maul
4,361,393 A 11/1982 Noto
4,368,972 A 1/1983 Naramore
4,385,827 A 5/1983 Naramore
4,397,469 A 8/1983 Carter, III
4,497,488 A 2/1985 Plevyak et al.
4,513,969 A 4/1985 Samsel, Jr.
4,515,367 A 5/1985 Howard
4,534,562 A 8/1985 Cuff et al.
4,566,782 A 1/1986 Britt et al.
4,586,712 A 5/1986 Lorber et al.
4,659,082 A 4/1987 Greenberg
4,667,959 A 5/1987 Pfeiffer et al.
4,741,524 A 5/1988 Bromage
4,750,743 A 6/1988 Nicoletti
4,770,421 A 9/1988 Hoffman
4,807,884 A 2/1989 Breeding
4,822,050 A 4/1989 Normand et al.
4,832,342 A 5/1989 Plevyak et al.
4,900,009 A 2/1990 Kitahara et al.
4,969,648 A 11/1990 Hollinger et al.
5,000,453 A * 3/1991 Stevens et al. ..... 273/149 R
5,067,713 A 11/1991 Soules et al.
5,121,921 A 6/1992 Friedman et al.
5,240,140 A 8/1993 Huen
5,261,667 A 11/1993 Breeding
5,275,411 A 1/1994 Breeding
5,288,081 A 2/1994 Breeding
5,303,921 A 4/1994 Breeding
5,356,145 A 10/1994 Verschoor
5,374,061 A 12/1994 Albrecht
5,382,024 A 1/1995 Blaha
5,382,025 A 1/1995 Sklansky et al.
5,390,910 A 2/1995 Mandel et al.
5,431,399 A 7/1995 Kelley
5,437,462 A 8/1995 Breeding
5,584,483 A 12/1996 Sines et al.
5,676,372 A 10/1997 Sines et al.
5,683,085 A 11/1997 Johnson et al.
5,690,324 A 11/1997 Otomo et al.
5,695,189 A 12/1997 Breeding et al.
5,718,427 A * 2/1998 Cranford et al. ..... 273/149 R
5,941,769 A 8/1999 Order
5,944,310 A * 8/1999 Johnson et al. ..... 273/149 R
5,989,122 A 11/1999 Roblejo
6,019,368 A * 2/2000 Sines et al. ..... 273/149 R
6,039,650 A 3/2000 Hill
6,068,258 A 5/2000 Breeding et al.
6,126,166 A 10/2000 Lorson et al.
6,139,014 A 10/2000 Breeding et al.
6,149,154 A 11/2000 Grauzer et al.
6,165,072 A 12/2000 Davis et al.
6,250,632 B1 * 6/2001 Albrecht ..... 273/149 R
6,254,096 B1 7/2001 Grauzer et al.
6,267,248 B1 7/2001 Johnson et al.

* cited by examiner

CARD SHUFFLING APPARATUS WITH INTEGRAL CARD DELIVERY

BACKGROUND OF THE INVENTION

1. Field of the Invention

This invention relates to shuffling and sorting apparatus for providing randomly arranged articles and especially to the shuffling of playing cards for gaming uses. The invention also relates to a method and apparatus for providing randomly shuffled deck(s) of cards in a rapid and efficient manner.

2. Background of the Art

In the gaming industry, certain games require that batches of randomly shuffled cards be provided to players and sometimes to dealers in live card games. It is important that the cards are shuffled thoroughly and randomly to prevent players from having an advantage by knowing the position of specific cards or groups of cards in the final mass of cards delivered in the play of the game. At the same time, it is advantageous to have the deck(s) shuffled in a very short period of time so that there is minimal down time in the play of the game.

U.S. Pat. No. 5,944,310 describes a card handling apparatus comprising: a loading station for receiving cards to be shuffled; a chamber to receive a main stack of cards; delivery means for delivering individual cards from the loading station to the chamber; a dispensing station to dispense individual cards for a card game; transfer means for transferring a lower most card from the main stack to the dispensing station; and a dispensing sensor for sensing one of the presence and absence of a card in the dispensing station. The dispensing sensor is coupled to the transfer means to cause a transfer of a card to the dispensing station when an absence of a card in the dispensing station is sensed by the dispensing sensor. Individual cards delivered from the loading station are randomly inserted by insertion means into different randomly selected positions in the main stack to obtain a randomly shuffled main stack from which cards are individually dispensed. The insertion means includes vertically adjustable gripping means to separate the main stack into two spaced substacks to enable insertion of a card between the substacks by the insertion means. The gripping means is positionable vertically along the edges of the main stack. After gripping, the top portion of the stack is lifted, forming two sub-stacks. At this time, a gap is created between the stacks.

Similarly, U.S. Pat. No. 5,683,085 describes apparatus for shuffling or handling cards including a chamber in which a main stack of cards are supported, a loading station for holding a secondary stack of cards, and card separating mechanism for separating cards at a series of positions along the main stack to allow the introduction of cards from the secondary stack into the main stack at those positions. The separating mechanism grips cards at the series of positions along the stack and lifts those cards at and above the separation mechanism to define spaces in the main stack for introduction of cards from the secondary stack.

U.S. Pat. No. 5,676,372 describes an automated playing card shuffler, comprising: a frame; an unshuffled stack holder for holding an unshuffled stack of playing cards; a shuffled stack receiver for holding a shuffled stack of playing cards; at least one ejector carriage mounted adjacent to said unshuffled stack holder, said at least one ejector carriage and said unshuffled stack holder mounted to provide relative movement between said unshuffled stack holder and said at least one ejector carriage; a plurality of ejectors mounted upon said at least one ejector carriage adjacent the unshuffled stack holder, for ejecting playing cards from the unshuffled stack, said ejecting occurring at various random positions along the unshuffled stack.

U.S. Pat. Nos. 6,139,014 and 6,068,258 describe a machine for shuffling multiple decks of playing cards in a batch process. The device includes a first vertically extending magazine for holding a stack of unshuffled playing cards, and second and third vertically extending magazines each for holding a stack of cards, the second and third magazines being horizontally spaced from and adjacent to the first magazine. A first card mover is positioned at the top of the first magazine for moving cards from the top of the stack of cards in the first magazine to the second and third magazines to cut the stack of unshuffled playing cards into two unshuffled stacks. Second and third card movers are at the top of the second and third magazines, respectively, for randomly moving cards from the top of the stack of cards in the second and third magazines, respectively, back to the first magazine, thereby interleaving the cards to form a vertically registered stack of shuffled cards in the first magazine. Elevators are provided in the magazines to bring the cards into contact with the card movers.

U.S. Pat. No. 6,019,368 describes a playing card shuffler having an unshuffled stack holder that holds an infeed array of playing cards. One or more ejectors are mounted adjacent the unshuffled stack holder to eject cards from the infeed array at various random positions. Multiple ejectors are preferably mounted on a movable carriage. Extractors are advantageously used to assist in removing playing cards from the infeed array. Removal resistors are used to provide counteracting forces resisting displacement of cards, to thereby provide more selective ejection of cards from the infeed array. The automated playing card shuffler comprises a frame; an unshuffled stack holder for holding an unshuffled array of playing cards in a stacked configuration with adjacent cards in physical contact with each other and forming an unshuffled stack; a shuffled array receiver for holding a shuffled array of playing cards; at least one ejector for ejecting playing cards located at different positions within the unshuffled stack; and a drive which is controllable to achieve a plurality of different relative positions between the unshuffled stack holder and said at least one ejector.

U.S. Pat. No. 6,149,154 describes an apparatus for moving playing cards from a first group of cards into plural groups, each of said plural groups containing a random arrangement of cards, said apparatus comprising: a card receiver for receiving the first group of unshuffled cards; a single stack of card-receiving compartments generally adjacent to the card receiver, said stack generally adjacent to and movable with respect to the first group of cards; and a drive mechanism that moves the stack by means of translation relative to the first group of unshuffled cards; a card-moving mechanism between the card receiver and the stack; and a processing unit that controls the card-moving mechanism and the drive mechanism so that a selected quantity of cards is moved into a selected number of compartments.

U.S. Pat. No. 6,254,096 describes an apparatus for continuously shuffling playing cards, said apparatus comprising: a card receiver for receiving a first group of cards; a single stack of card-receiving compartments generally adjacent to the card receiver, said stack generally vertically movable, wherein the compartments translate substantially vertically, and means for moving the stack; a card-moving mechanism between the card receiver and the stack; a processing unit that controls the card-moving mechanism and the means for moving the stack so that cards placed in the card receiver are moved into selected compartments; a second card receiver for receiving cards from the compartments; and a second card-moving mechanism between the compartments and the second card receiver for moving cards from the compartments to the second card receiver.

U.S. Pat. No. 6,267,248 describes an apparatus for arranging playing cards in a desired order, said apparatus including: a housing; a sensor to sense playing cards prior to arranging; a feeder for feeding said playing cards sequentially past the sensor; a storage assembly having a plurality of storage locations in which playing cards may be arranged in groups in a desired order, wherein the storage assembly is adapted for movement in at least two directions during shuffling; a selectively programmable computer coupled to said sensor and to said storage assembly to assemble in said storage assembly groups of playing cards in a desired order; a delivery mechanism for selectively delivering playing cards located in selected storage locations of the storage assembly; and a collector for collecting arranged groups of playing cards.

Although these and other structures are available for the manufacture of playing card shuffling apparatus, new improvements and new designs are desirable.

SUMMARY OF THE INVENTION

A device for forming a random set of playing cards is described. The device includes a top surface and a bottom surface, and a card receiving area for receiving an initial set of playing cards. A randomizing system is provided for randomizing the initial set of playing cards. A collection surface is located in a card collection area for receiving randomized playing cards, the collection surface receiving cards so that all cards are received below the top surface of the device. An elevator is provided for raising the collection surface so that at least some randomized cards are elevated at least to the top surface of the device.

A device for forming a random set of playing cards is described. The device includes a top surface and a bottom surface of said device and a receiving area for an initial set of playing cards. A randomizing system is provided for randomizing the initial set of playing cards. A collection surface is provided in a card collection area for receiving randomized playing cards. The device further includes an elevator for raising the collection surface within the card collection area. At least one card supporting element within the card collection area supports a randomly determined number of cards within the card collection area. A card insertion point is created in the card collection area beneath the randomly determined number of cards.

An automatic card shuffling device is disclosed. The device includes a microprocessor with memory for controlling the operation of the device. An infeed compartment is provided for receiving cards to be randomized. A card moving mechanism moves cards individually from the infeed compartment into a card mixing compartment. The card mixing compartment includes a plurality of substantially vertical supports and an opening for the passage of cards from the infeed compartment. The card mixing compartment also includes a moveable lower support surface and at least one stationary gripping arm, a lower edge proximate the opening, the gripping arm. The gripping arm is capable of suspending a group of cards of a randomly determined size above the opening. In one example, the opening is a horizontal slot.

An elevator is provided for raising and lowering the moveable support surface. In operation, the vertical position of the elevator is randomly selected and the support surface is moved to the selected position. After the gripping arm grasps at least one side of the cards, the elevator lowers, creating a space beneath the gripping arm, wherein a card is moved from the infeed compartment into the space, thereby randomizing the cards.

A method of randomizing a group of cards is described. The method comprises the steps of placing a group of cards to be randomized into a card infeed tray and removing cards individually from the card infeed tray and delivering the cards into a card collection area. The card collection area has a moveable lower surface, and a stationary opening for receiving cards from the infeed tray. The method includes elevating the moveable lower surface to a randomly determined height and grasping at least one edge of a group of cards in the card collection area at a point just above the stationary opening. The method further includes the steps of lowering the moveable lower surface to create an opening in a stack of cards formed on the lower surface, the opening located just beneath a lowermost point where the cards are grasped and inserting a card removed from the infeed tray into the opening.

DETAILED DESCRIPTION OF THE INVENTION

Figure 1:
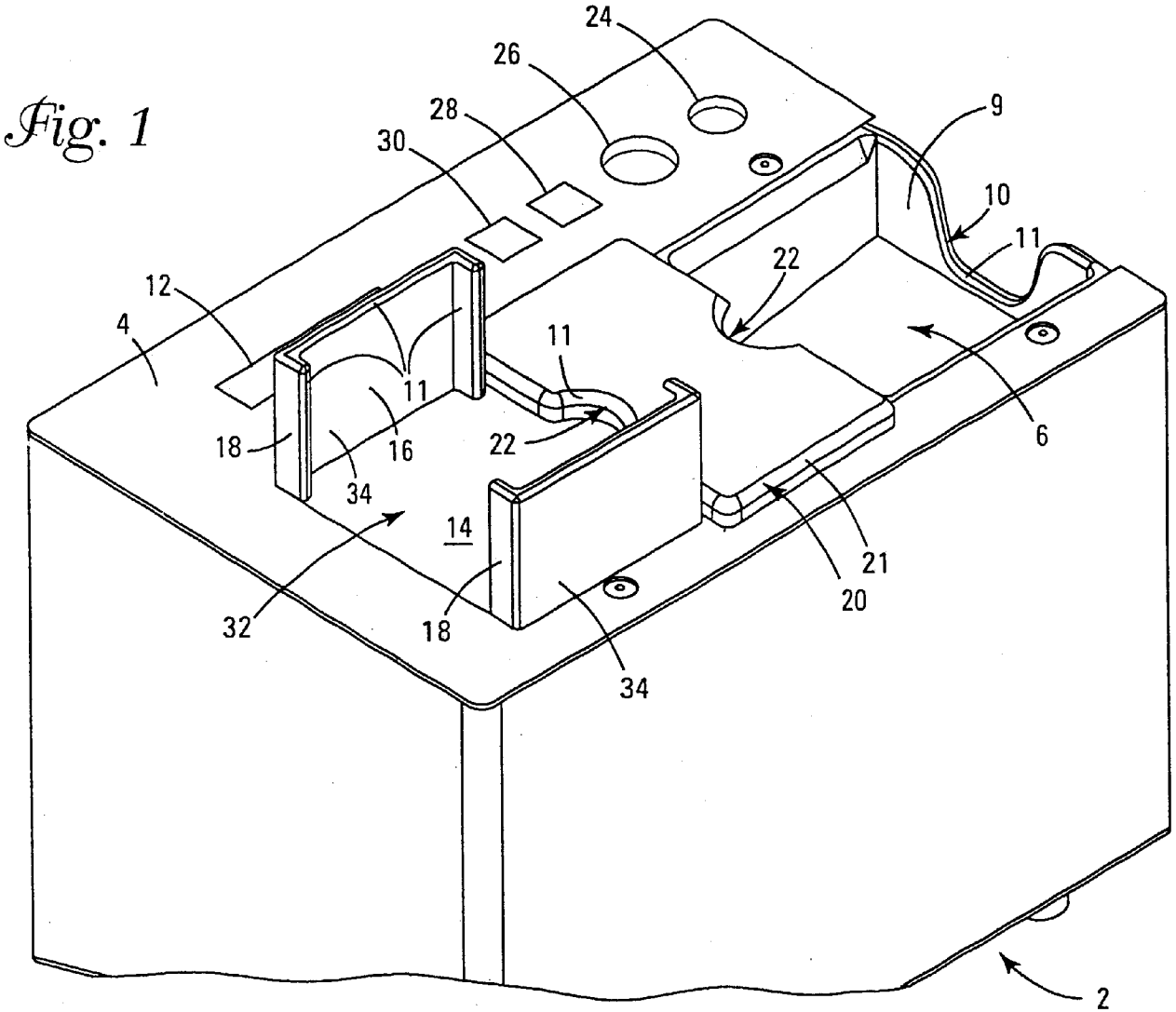
FIG. 1 shows a perspective view of the exterior shell of a shuffling apparatus.

An automatic shuffling device is described for forming a random set of playing cards. One embodiment of the device of the present invention shuffles a single or double deck of cards (standard deck or decks of 52 cards each or 52 cards plus one or two jokers) and is particularly well suited for providing randomized decks of cards for specialty games such as double deck blackjack, and draw poker games, for example.

The device includes a top surface and a bottom surface, a card receiving area for receiving an initial set of playing cards to be randomized and a randomizing system for randomizing the initial set of playing cards. The device further includes a collection surface within a card collection area for receiving randomized playing cards, the collection surface receiving cards in a manner such that that all cards are received below the top surface of the device. An elevator is provided for raising and lowering the collection surface during shuffling, and elevating the shuffled group of cards at least as high as the top surface of the device. Once the cards are elevated, they can be removed by the attendant or dealer and used for dealing. While cards are being dealt, a second group of cards is being randomized. The use of two groups of cards eliminates any waiting on the part of the dealer or the casino patrons between rounds of play.

There are a number of special features that combine to make the invention a significant advance over previously described card shuffling systems and card shuffling processes. Among individual features that constitute an advance, alone or in combination with other features include an elevator for moving the final set of randomized cards upwardly so that the stack is accessible to the dealer or attendant. The same elevator advantageously assists in accomplishing shuffling within the card collection area.

The card collection area in one example of the invention has a plurality of vertical supports, and a moveable lower surface. The elevator supports this moveable lower surface and causes the surface to move back and fourth in a substantially vertical direction.

A picking or separating system is provided for lifting segments of the stack of cards present in the card collection area so that cards can be inserted in specific locations relative to other cards in the deck. According to the invention, the picking system is fixed in the vertical direction. By selecting a vertical location for a moveable base of the card receiving area prior to picking, the location within the stack is varied, causing randomization of the cards.

Offset rollers are provided for moving the individual cards from the card receiving area into the card collection area. A stack stabilizing area is provided for receiving an elevated final set of cards lifted from the card collection area. A single belt drive is provided in one example of the invention for driving two spaced apart and opposed picking elements in a card segment picking system. A microprocessor is provided that identifies or creates an intended distribution of an initial set of cards in the card receiving area at the conclusion of shuffling. The microprocessor executes movement of elements in the shuffling apparatus, including the opposed picking elements and the elevator to effect placement of each card into spaces in the stack created by the shuffling apparatus, and a randomized set of cards is rapidly formed.

The individual and combined elements of the invention will be described in detail, after a more general description of the invention is provided. A first general description of the invention is a device for forming a random set of playing cards comprising: a top surface and a bottom surface of said device; a receiving area for an initial set of playing cards; a randomizing system for randomizing the order of the initial set of playing cards; a collection surface in a card collection area for receiving the randomized playing cards; an elevator for raising the collection surface within the card collection area; and at least one card supporting element within the card collection area that is fixed with respect to the vertical, and will support and suspend a randomly determined number of cards within the card collection area. A card insertion point is provided in the card collection area and is positioned just below the lowermost portion of the card supporting element or elements.

The device may have one or more card supporting elements comprising at least one element on at least one side of the card collection area. In the alternative, the card supporting elements include at least two opposed supporting elements such as gripping elements that can move inwardly within the card collection area to contact and support the edges of at least a portion of the stack of cards. The stack may be defined as all cards at or above a randomly selected card or position in the stack within the card collection area. The device desirably has a microprocessor communicatively connected to the device. The microprocessor in one example of the invention is programmed to determine a distance that the card supporting surface must be vertically moved in order to position each card in the desired order within the stack. In one example of the invention, cards fed into the card collection area may be placed anywhere in the stack.

The microprocessor is communicatively connected to the device and may be programmed to lower the card collection surface within the card collection area after the at least one card supporting element has contacted and supported cards within the card collection area, creating two vertically spaced segments of cards separated by a gap or opening between the cards. The microprocessor may direct movement of one or more individual cards into the gap created between the two segments (upper and lower) of cards. The microprocessor may be programmed to randomly determine a distance that the card supporting surface must be vertically moved to in order to position at least one specific card. In the alternative, the microprocessor may be programmed to select a specific card position below or above a certain card, creating the gap. When the card supporting element moves to contact cards within the card collection area, and the elevator moves the card supporting surface downwardly, a gap is created for receiving the next card.

Another general description of a device according to the invention is a device for forming a random set of playing cards comprising: a top surface and a bottom surface of said device; a receiving area for supporting an initial set of playing cards to be randomized; a randomizing system for randomizing the initial set of playing cards; a collection surface in a card collection area for receiving randomized playing cards, the collection surface being moveable in a vertical direction. In one example of the invention, cards are received on the collection surface. All cards being randomized in this example are inserted into the card collection area at a location below the top surface of the device. Cards are fed individually off of the bottom of the stack located in the card receiving area and into the card collection area in one example of the invention.

An elevator is provided for raising the collection surface so that at the conclusion of shuffling, at least some randomized cards are elevated to a position at or above the top surface of the device. The elevator may be capable of raising all or part of the randomized cards at or above the top surface of the device. The device may have a confining set of walls defining a shuffled card delivery area that confine all randomized cards along all edges after the randomized cards are elevated. The delivery area may be positioned such that its lower interior surface is at the same elevation as the top surface of the shuffler. The lower interior surface may be elevated above the top surface, or positioned beneath the top surface of the shuffler. In one example of the invention, the lower interior surface is at the same elevation as the top of the exterior of the shuffler.

The card receiving area may be sloped downwardly towards to randomizing system to assist movement of playing cards. The device may have at least one pick-off roller to remove cards one at a time from the card receiving area and to move cards, one at a time towards the randomizing system. The at least one pair of speed up rollers desirably receive cards from the at least one pick-off roller. A microprocessor preferably controls movement of the pick-off roller and the at least one pair of speed up rollers. The first card is preferably moved by the pick-off roller so that, as later described in greater detail, movement of the pick-off roller is altered (stopped or tension contact with the card is reduced or ended) so that no card other than the first card is moved by either the pick-off roller or the at least one pair of speed up rollers. This can be done by sensing of tension on the first card effected by the at least one pair of rollers, causing the pick-off roller to freely rotate and to not propel the card.

The microprocessor for example, may be programmed to direct the pick-off roller to cease propelling a first card being moved by the pick-off roller when it is sensed that the first card is being moved by the at least one pair of rollers. A preferred randomization system moves one card at a time into an area overlying the collection surface. It is desirable to have one card at a time positioned into a randomized set of playing cards over the playing card collection surface. Again, as with the first general structure, the card collection area may be bordered on two opposed sides by two movable card supporting elements. There is preferably an insertion point, such as an opening or slot to the card collection area that is located below a bottom edge of the two movable card supporting elements. The card supporting surface is vertically positionable within the card collection area, usually under the control and direction of a microprocessor. For example, the card supporting surface is moved by a motivator or elevator that is able to move incremental vertical distances that are no greater than the thickness of a playing card, such as incremental vertical distances that are no greater than one-half the thickness of a playing card. The motor may be, for example, a stepper motor or an analog motor. A sensor may be present within the collection area, below the top surface of the device, the sensor detecting a position of a top card of a group of cards in the card collection area. In the alternative, the sensor detects the level of the card collection surface. A microprocessor is preferably present in the device to control vertical movement of the card supporting surface. The sensor may identify the position of the collection plate to place the top card at a position level with the bottom of at least one card supporting element that is movable substantially horizontally from at least one side of the collection area towards playing cards within the card collection area.

In one example of the invention, and opening such as a slot is provided in a side wall of the card collection area to permit transfer of cards from the card receiving area into the card collection area. The side wall may comprise a substantially solid support structure; adjoining edges of a plurality of vertical "L" shaped corner support structures, or other equivalent structure capable of retaining a stack of cards in a substantially upright position. The microprocessor may be programmed to determine a distance that the card supporting surface must be vertically moved to position at least one specific card, including or other than the top card at a bottom edge of the at least one card supporting element when the card supporting element moves to contact cards within the card collection area. As previously described, the at least one card supporting element may comprise at least two elements such as gripping pads that move from opposed sides of the collection area towards playing cards within the card collection area. The microprocessor may be programmed to lower the card collection surface within the card collection area after the at least one card supporting element has contacted and supported cards within the card collection area, creating two vertically spaced apart segments of cards. The microprocessor directs movement of an individual card into the card supporting area between the two segments of cards. The microprocessor may direct movement of playing card moving elements within the device. The microprocessor randomly assigns potential positions for each card within the initial set of playing cards, and then directs the device to arrange the initial set of playing cards into those randomly assigned potential positions to form a randomized final set of playing cards.

In one embodiment of the invention, the card receiving area is located such that individual cards are fed off of the bottom of the stack, through the slot formed in the card collection area, directly beneath the gripping elements. In another example of the invention, an elevator is provided so that the cards can be loaded into the card receiving area at an elevation above that of the first embodiment. The elevator then lowers the cards to a vertical position aligned with the feed mechanism.

An elevator is provided for moving the cards being randomized and operates to raise and lower the bottom support surface of the card collection area. This elevator moves during randomization, and also aids in the delivery of the shuffled group of cards. Reference to the figures will assist in appreciation and enablement of the practice of the present invention.

FIG. 1 shows a partial perspective view of the top surface 4 of a shuffling apparatus 2 according to a practice of the invention. The shuffling apparatus has a card accepting/receiving area 6 that is preferably provided with a lower support surface that slopes downwardly from the nearest outer side 9 of the shuffling apparatus 2. A depression 10 is provided in that nearest outer side 9 to facilitate an operator's ability to place or remove cards into the card accepting/receiving area 6. The top surface 4 of the shuffling apparatus 2 is provided with a visual display 12 (e.g., LED, liquid crystal, micromonitor, semiconductor display, etc.), and a series of buttons, touchpads, lights and/or displays 24, 26, 28 and 30. These elements on the top surface 4 of the shuffling device 2 may act to indicate power availability (on/off), shuffler state (jam, active shuffling, completed shuffling cycle, insufficient numbers of cards, missing cards, sufficient numbers of cards, complete deck(s), damaged or marked cards, entry functions for the dealer to identify the number of players, the number of cards per hand, access to fixed programming for various games, the number of decks being shuffled, and the like).

Also shown in FIG. 1 is a separation plate 20 with a beveled edge 21 and two manual access facilitating recesses 22 that assists an operator in accessing and removing jammed cards between the card accepting area 6 and the shuffled card return area 32. The shuffled card return area 32 is shown to be provided with an elevator surface 14 and two separated card-supporting sides 34. In a preferred embodiment, sides 34 are removeable. When the shuffler is flush-mounted into the top of a gaming table surface, removal of sides 32 enables the device to lift shuffled groups of cards onto the gaming table surface for immediate use. The card supporting sides surround a portion of the elevator surface 14 with interior faces 16 and blocking extensions 18. It is desirable to provide rounded or beveled edges 11 on edges that may come into contact with cards to prevent scratching, catching or snagging of cards, or scratching of operators' fingers or hands.

Figure 2:
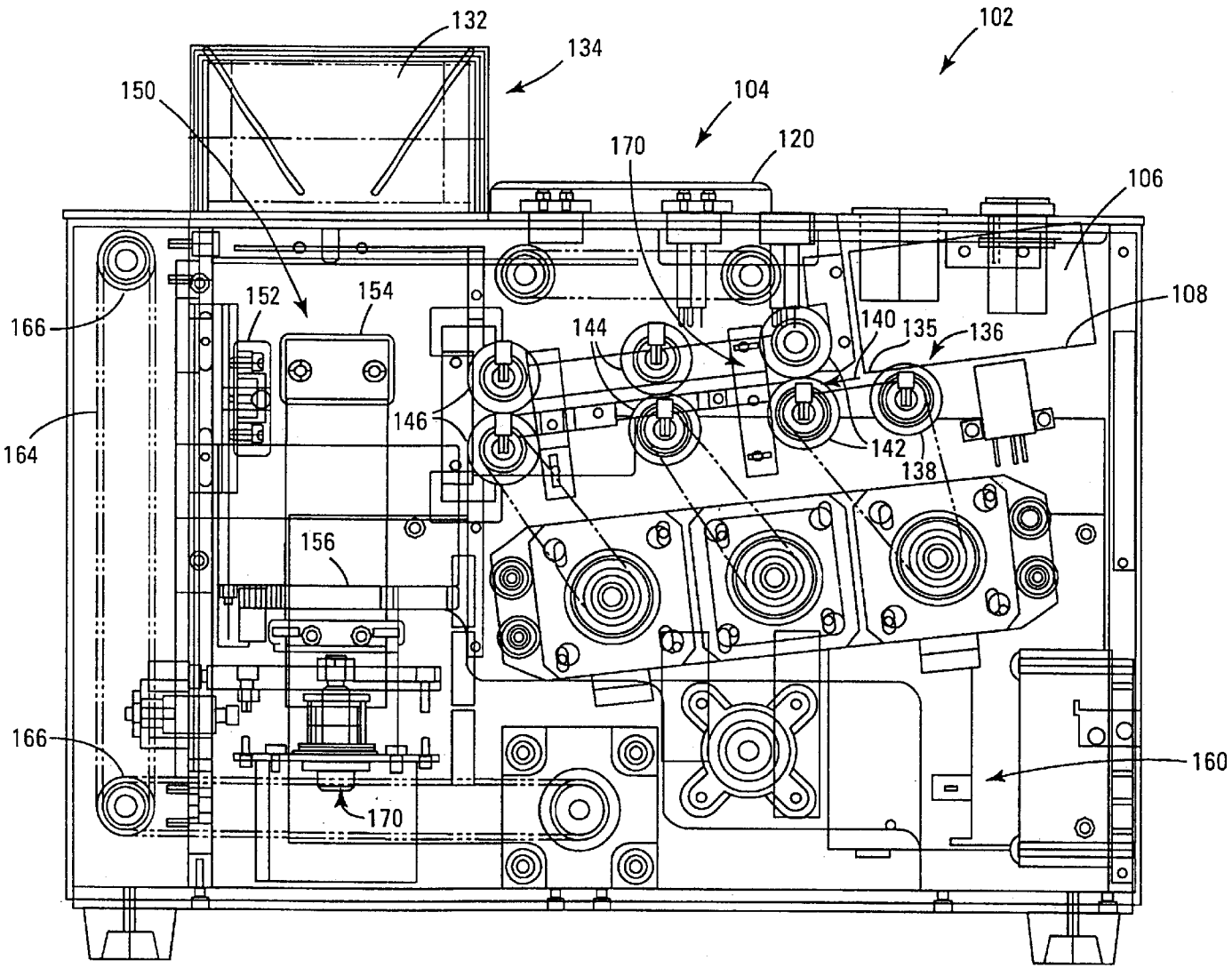
FIG. 2 shows a cutaway side view of the internal elements of a shuffling apparatus according to teachings of the present invention.

FIG. 2 shows a cutaway side view of one embodiment of a shuffling apparatus 102 according to the present invention. The top surface 104 is shown with a separation plate 120 and the side panels 134 of the shuffled card receiving area 132. The card accepting/receiving area 106 is recessed with respect to the top surface 104 and is shown with a declining sloping surface 108. At the front 135 of the sloping surface 108 is an opening 136 (not able to be seen in the direct side view) through which a bottom pick-off wheel 138 may contact a bottom card in an unshuffled set of cards (not shown) within the card accepting/receiving area 106. The bottom pick-off roller 138 drives a card in direction 140 by frictional contact towards a first pair of nip rollers or off-set rollers 142. In one example of the invention, the upper roller of off-set rollers 142 is a break roller. This break roller retains the second top card for separation in the event that two cards are fed at the same time. In a preferred form of the invention, the upper roller does not rotate. In another form of the invention, the upper roller rotates, but is constrained.

There are an additional two pairs 144 146 of nip rollers or off-set rollers acting in concert to move cards first moved by the first set of nip rollers 142. In a preferred practice of the present invention, the operation of the apparatus 102 may perform in the following manner. When a card (not shown) is moved from the unshuffled card accepting/receiving area 106, eventually another card in a stack of cards within the card accepting/receiving area 106 is exposed. The apparatus is designed, programmed and controlled to operate so that individual cards are moved into the first set of nip rollers or off-set rollers 142. If more than one card from the card accepting/receiving area advances at any given time (even if in partial sequence, with a portion of one card overlapping another card), it will be more difficult or even impossible for the apparatus to direct individual cards into predetermined positions and shuffle the cards randomly.

If two cards are moved at the same time and positioned adjacent to each other, this uncontrollably decreases the randomness of the shuffling apparatus. It is therefore desirable to provide a capability whereby when a card is moved into the control area of the first set of nip rollers or off-set rollers 142, the drive function of the bottom pick-off roller 138 ceases on that card and/or before the bottom pick-off roller 138 drives the next card. This can be effected by a wide variety of techniques controlled or directed by a microprocessor, circuit board, programmable intelligence or fixed intelligence within the apparatus.

Among the non-limiting examples of these techniques are 1) a sensor so that when a pre-selected portion of the card (e.g., leading edge, trailing edge, and mark or feature on the card) passes a reading device, such as an optical reader, the bottom pick-off roller 136 is directed to disengage, revolve freely, or withdraw from the bottom of the set of cards; 2) the first set of nip rollers or off-set rollers 144 may have a surface speed that is greater than the surface speed of the bottom pick-off roller 138, so that engagement of a card applies tension against the bottom pick-off roller 138 and the roller disengages with free rolling gearing, so that no forward moving (in direction 135) forces are applied to the first card or any other card exposed upon movement of the first card; 3) a timing sequence so that, upon movement of the bottom pick-off roller for a defined period of time or for a defined amount of rotation (which correlates into a defined distance of movement of the first card), the bottom pick-off roller 138 disengages, withdraws, or otherwise stops applying forces against the first card and thereby avoids applying forces against any other cards exposed by movement of the first card from the card accepting/receiving area 106 and 4) providing a stepped surface (not shown) between pick-off roller 138 and off-set rollers 146 that contacts a leading edge of each card and will cause a card to be held up or retained in the event that more than one card feeds at a time.

The cards are eventually intended to be fed, one-at-a-time from final nip rollers or off-set rollers 146 into the card mixing area 150. The cards in the mixing area 150 are supported on elevator platform 156. The platform 156 moves the stack of cards present in the mixing area up and down as a group to be addressed by separation element 154. The separation element 154 grips an upper portion of cards, supports those cards while the elevator drops sufficiently to provide an opening for insertion of a card into the stack. This movement within the apparatus 102 in the performance of the shuffling sequence offers a significant speed advantage in the shuffling operation as compared to U.S. Pat. No. 5,683,085, especially as the number of cards in the card mixing area 150 increases. Rather than having to lower the entire stack of cards to the bottom of the card receiving area and reposition the pickers (as required by U.S. Pat. No. 5,683,085), the cards in the present apparatus may be dropped by the pickers or the elevator needs to move only a slight distance to recombine the cards supported by the separation element 154 (a gripper, and insertion support, fingers, friction engaging support, rubber fingers, etc.) with the cards supported on the elevator platform 156.

The stationary pair of gripping pads also maintain their alignment with respect to each other and grip the cards more securely than the device described in U.S. Pat. No. 5,683,085, reducing or eliminating the unintentional dropping of a card or cards that were intended to be gripped, rather than lowered. Whenever cards are dropped, the randomness of the final shuffle may be adversely affected.

The elevator of a device with stationary grippers may then be moved to the next directed separation position, which would require, on average, less movement than having to reset the entire deck to the bottom of the card supporting area and then moving the picker, and then raising the picker to the card insertion point, as required in U.S. Pat. No. 5,683,085.

The microprocessor 160 controls and directs the operation of the shuffling apparatus 102. The microprocessor 160 also receives and responds to information provided to it. For example, a set of sensing devices 152 are used to determine the movement point of the elevator that positions the top card in a set of cards (not shown) within the card mixing area 150 at a specific elevation. The sensing devices 152 identify when an uppermost card on the platform 156 or the top of the platform itself is level with the sensors 152. This information is provided to the microprocessor. A reading system 170 may also be used to provide information, such as the number of cards that have been fed from the card accepting/receiving area 106 into the card mixing area 150 so that the number of cards shuffled and the number of cards present on the platform 150 at any given time is known. This information, such as the number of cards present within the card mixing area 150, is used by the microprocessor 160, as later explained to randomly arrange and thus shuffle cards according to the programming of the system.

For example, the programming may be performed as follows. The number of cards in a set of cards intended to be used in the system is entered into the data bank of the microprocessor. Each card in the set of cards is provided with a specific number that is associated with that particular card, herein referred to as the original position number. This is most conveniently done by assigning numbers according to positions within the original (unshuffled) set of cards. If cards are fed from the bottom of the stack into the randomizing apparatus, cards are assigned numbers from the bottom to the top. If cards are fed from the top of the stack or the front of a stack supported along its bottom edges, then the cards are numbered from top to bottom, or front to rear.

A random number generator (which may be part of the microprocessor 160 or may be external to the device) then assigns a random position number to each card within the original set of cards, the random position number being the randomly determined position that each card will occupy in the randomly associated set of cards ultimately resulting in a shuffled set of cards. The microprocessor identifies each card by its original position number. This is most easily done when the original position number directly corresponds to its actual position in the set, such as the bottom-most card being CARD 1, the next card being CARD 2, the next card being CARD 3, etc. The microprocessor, taking the random position number, then directs the elevator to move into position where the card can be properly inserted into the randomized or shuffled set of cards. For example, a set of randomized positions selected by a random number generator for a single deck is provided below. OPN is the Original Position Number and RPN is the Random Position Number.

| OPN | RPN |
|---|---|
| 1 | 13 |
| 2 | 6 |
| 3 | 39 |
| 4 | 51 |
| 5 | 2 |
| 6 | 12 |
| 7 | 44 |
| 8 | 40 |
| 9 | 3 |
| 10 | 17 |
| 11 | 25 |
| 12 | 1 |
| 13 | 49 |
| 14 | 10 |
| 15 | 21 |
| 16 | 29 |
| 17 | 33 |
| 18 | 11 |
| 19 | 52 |
| 20 | 5 |
| 21 | 18 |
| 22 | 28 |
| 23 | 34 |
| 24 | 9 |
| 25 | 48 |
| 26 | 16 |
| 27 | 14 |
| 28 | 31 |
| 29 | 50 |
| 30 | 7 |
| 31 | 46 |
| 32 | 23 |
| 33 | 41 |
| 34 | 19 |
| 35 | 35 |
| 36 | 26 |
| 37 | 42 |
| 38 | 8 |
| 39 | 43 |
| 40 | 4 |
| 41 | 20 |
| 42 | 47 |
| 43 | 37 |
| 44 | 30 |
| 45 | 24 |
| 46 | 38 |
| 47 | 15 |
| 48 | 36 |
| 49 | 45 |
| 50 | 32 |
| 51 | 27 |
| 52 | 22 |

The sequence of steps in the shuffling or randomizing procedure may be described as follows for the above table of card OPN's and RPN's. OPN CARD 1 is carried from the card accepting receiving area 106 to the final nip rollers or off-set rollers 146. The final nip rollers or off-set rollers 146 place CARD 1 onto the top of the platform, which has been appropriately positioned by sensing by sensors 152. OPN CARD 2 is placed on top of CARD 1, without the need for any gripping or lifting of cards. The microprocessor identifies the RPN position of CARD 3 as beneath both CARD 1 and CARD 2, so the elevator 156 lifts the cards to the gripping element 154 which grips both CARD 1 and CARD 2, then supports those two cards while the elevator retracts, allowing CARD 3 to be placed between the elevator platform 156 and the two supported cards. The two cards (CARD 1 and CARD 2) are then placed on top of CARD 3 supported by the platform 156. For the fourth card (CARD 4) with RPN 51. The elevator would position the three cards in the pile so that all three cards would be lifted by the card separation element, and the fourth card inserted between the three cards (CARD 1, CARD 2 and CARD 3) and the platform 156. The fifth card (CARD 5) has an RPN of 2, so that the apparatus merely requires that the four cards be positioned below the insertion point from the last two nip rollers 146 by lowering the platform 150. Positioning of the sixth card (CARD 6) with an RPN of 12 requires that the elevator raise the complete stack of cards, the sensors 152 sense the top of the stack of cards, elevate the stack of cards so that the separators 154 grip only the top two cards (RPN positions 2 and 6), lower the platform 156 slightly, and then CARD 6 with an RPN of 12 can be properly inserted into an opening in the developing randomized set of cards. This type of process is performed until all 52 cards (for a single deck game) or all 104 cards (for a double deck game) are randomly associated into the final randomized set or shuffled set of cards. The apparatus may be designed for larger groups of cards than single fifty-two card decks, including 52 card decks plus special (wild cards or jokers) cards, two fifty-two card decks, and two fifty-two card decks plus special cards. Larger groupings of cards (e.g., more than 108 cards) may also be used, but the apparatus has been optimized for one or two deck shuffling in a preferred practice of the present invention.

Elevation of the elevator or platform 156 may be effected by any number of commercially available type systems. It is important that the elevator is capable of providing precise and refined movement and repeated movements that do not exceed one card thickness. If the minimum degree of movement of the elevator exceeds one card thickness, then precise positioning could not be effected. It is preferred that the degree of control of movement of the elevator does not exceed at least one-half the card thickness. In this manner, precise positioning of the cards with respect to the separating elements 154 can be effected. Additionally, it is often desirable to standardize, adjust, or calibrate the position of the elevator (and/or cards on the elevator) at least once and often at intervals to assure proper operation of the apparatus 102. In one example of the invention, the microprocessor 160 calls for recalibration periodically, and provides the dealer with a warning or calibration instructions on the display 12.

Particularly desirable elevator control mechanisms would be servo systems or stepper motors and drive belts (essentially more like digital systems). Stepper motors are commercially available that can provide or can be readily adjusted to provide incremental movements that are equal to or less than one card thickness, with whole fractions of card thicknesses, or with indefinite percentages of card thicknesses. Exact correspondence between steps and card thickness is not essential, especially where the steps are quite small compared to the card thickness. For example, with a card thickness of 0.2 mm, the steps may be 0.2 mm, 0.15 mm, 0.1 mm, 0.08 mm, 0.075 mm, 0.05 mm, 0.04 mm, 0.01 mm, 0.001 mm or smaller, and most values there between. It is most desirable to have smaller values, as some values, such as the 0.17 mm value of a step, can cause the gripper in the separation element to extend over both a target position to be separated and the next lower card in the stack to be gripped, with no intermediate stepping position being available. This is within the control of the designer once the fundamentals of the process have been understood according to the present description of the practice of the invention. As shown in FIG. 2, a drive belt 164 is attached to two drive rollers 166 which move the elevator platform 156. The belt 164 is driven by a stepper motor system 170 which is capable of 0.001 mm steps.

Figure 3:
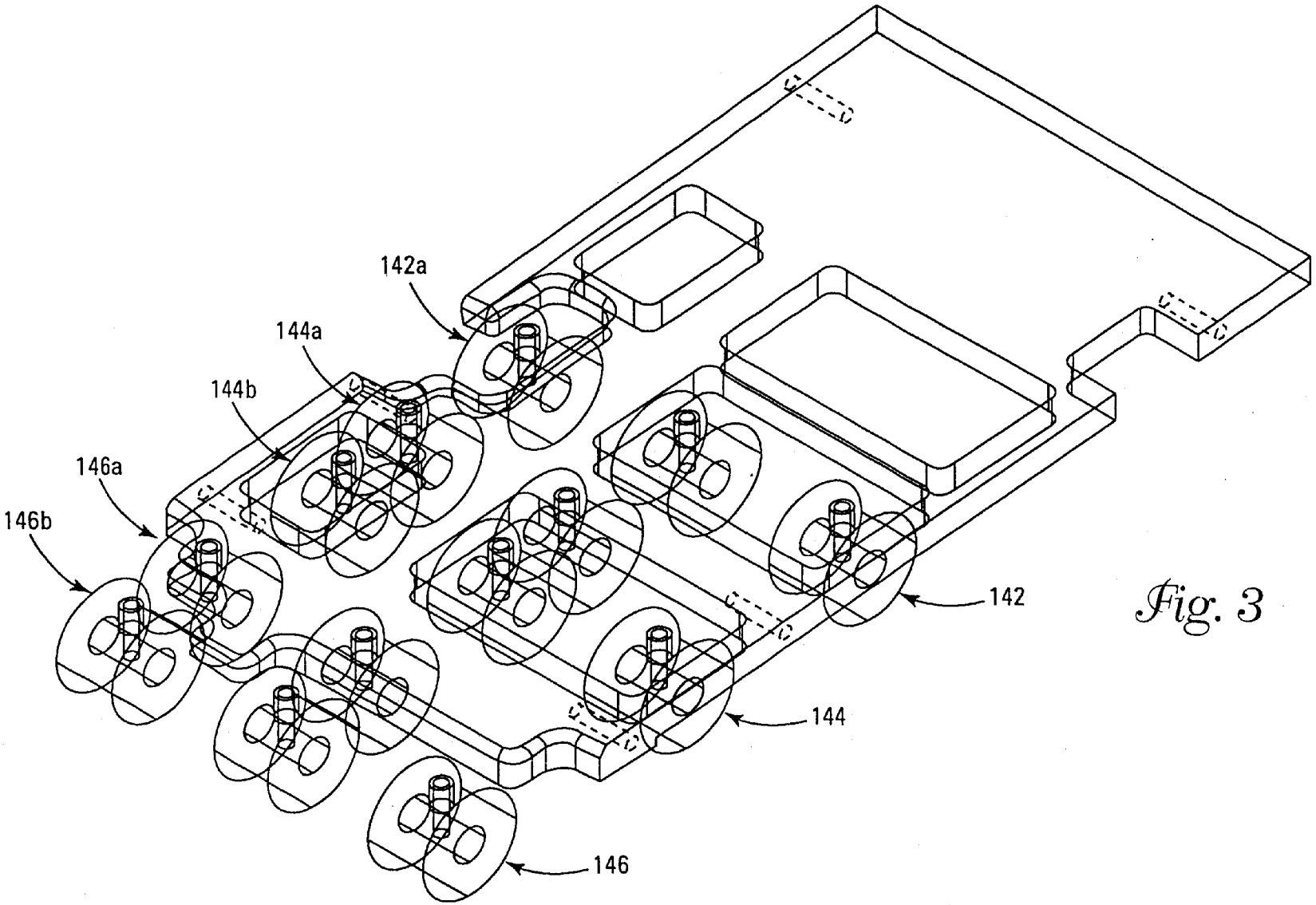
FIG. 3 shows a perspective view of an off-set card transport mechanism according to an embodiment of the invention.

FIG. 3 shows a perspective cutaway of the drive rollers or nip rollers 142, 144 and 146. These are not truly sets of nip rollers, but are off-set rollers, so that rollers 142*a* and 142*b*, 144*a* and 144*b*, 146*a* and 146*b* are not precisely linearly oriented. By selecting a nip width that is not so tight as to press a card from both sides of the card at a single position, and by selecting offset rollers rather than aligned nip rollers, fluid movement of the card, reduced damage of the card, and reduced jamming may be provided. This is a particularly desirable aspect of a preferred practice of the present invention, which is shown also in FIG. 4.

Figure 4:
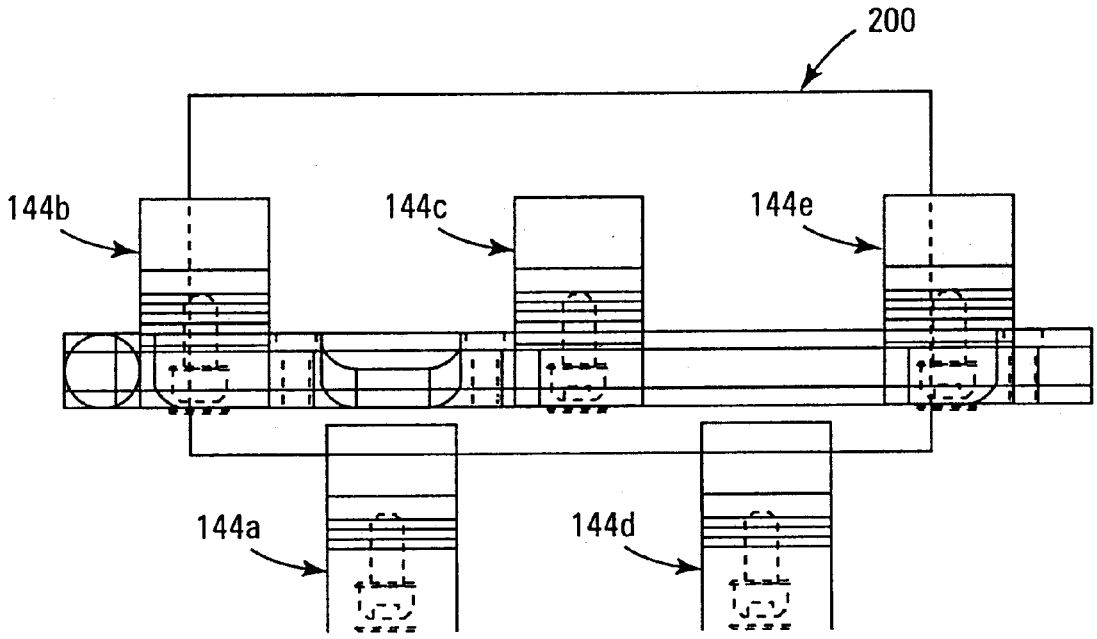
FIG. 4 shows a top view of an off-set card transport mechanism according to an embodiment of the present invention.

FIG. 4 shows a set of off-set rollers 144*a*, 144*b*, 144*c*, 144*d* and 144*e* transporting a card 200. The card 200 is shown passing over rollers 144*a* and 144*d* and under rollers 144*b*, 144*c* and 144*e*. As can be seen, the rollers are not capable of contacting a card to precisely overlap at a specific point on opposite sides of a card.

Figure 5:
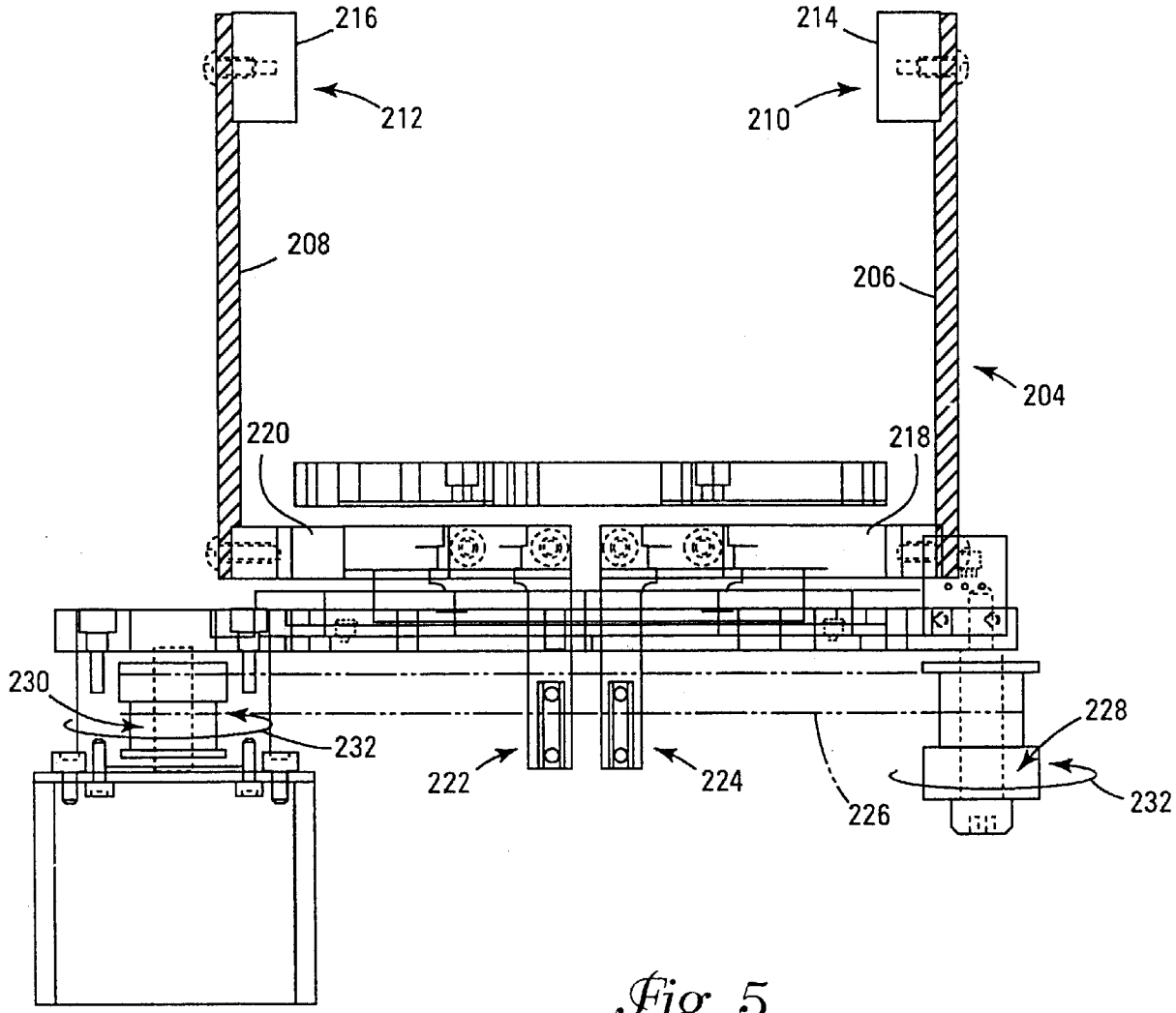
FIG. 5 shows a cross-sectional view of an embodiment of a picking system with a single or joint belt drive for moving picker elements.

FIG. 5 shows a cross-section view of one embodiment of a gripping system 204 that may be used in the practice of the invention. The Figure shows two support arms 206 and 208 that support gripping elements 210 and 212, which comprise semi-rigid gripping pads 214 and 216. These gripping pads 214 and 216 may be smooth, grooved, covered with high friction material such as rubber or neoprene, ribbed, straight, sloped or the like to take advantage of various physical properties and actions. The support arms 204 and 208 are attached to separately moveable positioning arms 218 and 220. These positioning arms are referred to as separately moveable, in that they are not physically connected, but one tends to move from left to right while the other moves right to left (with respect to the view shown in FIG. 5) as the two positioning arms move in and out (substantially horizontally) to grip or release the cards. However, preferably they do not move independently, but should move in concert. It is also desirable that they are fixed with respect to the vertical. If the positioning arms moved completely independently (horizontally, during gripping), with only one moving to attempt to contact the cards at a time, the first contacting arm would move cards out of vertical alignment.

Although the arms may not move the contact pads 214 and 216 into contact with absolute precision, they should contact opposite edges of the cards at approximately the same time, without moving any cards more than 5% of the length of a card (if contacted lengthwise) or 7% of the width (if contacting the cards widthwise). An example of one mechanism for moving the positioning arms in concert is by having a drive belt 226 that engages opposite sides of two connectors 222 and 224 that are attached to positioning arms 220 and 218, respectively. The belt 226 contacts these connectors 222 and 224 on opposite sides, such as contact connector 224 on the rear side, and contact connector 222 on the front side. As the belt 226 is driven by rotors 228 and 230, with both rotors 228 and 230 turning in direction 232, connector 222 will be moved from left-to-right, and connector 224 will be moved from right to left. This will likewise move contact pads 214 and 216 inwardly to grip cards. The use of such pads is much preferred over the use of rigid, pointed, spatula elements to separate cards, as these can damage cards, not only increasing the need for replacement, but also by marking cards which could reduce security.

The apparatus may also contain additional features such as card reading sensor(s) to identify suits and ranks of cards; feed means for feeding cards sequentially past the sensor; at various points within the apparatus; storing areas in which the cards stored in a desired order or random order; selectively programmable artificial intelligence coupled to the sensor(s) and to said storing areas to assemble in said storing areas groups of articles in a desired order; delivery systems for selectively delivering the individual articles into the storing areas, and collector areas for collecting collated groups of articles.

The sensor(s) may include the ability to identify the presence of an article in particular areas, the movement or lack of movement in particular areas, reading of cards to identify spurious or counterfeit cards and detection of marked cards. This can be suitably effected by providing the sensor with the capability of identifying one or more physical attributes of an article. This includes the sensor having the means to identify indicia on a surface of an article. The desired order may be a specific order of one or more decks of cards to be sorted into its original pack order or specific order, or it may be a random order into which a complete set of articles is delivered from a plurality of sets of randomly arranged articles. For example, the specific order may be effected by feeding cards into the card accepting area with a sensor identifying the suit and rank, and having a pre-established program to assign cards, based upon their rank and suit, into particular distributions onto the elevator platform. The sensing can take place in the card receiving area when the cards are stationary, or while the cards are in motion.

The suit and rank and position of all cards in the card accepting/receiving area will then be known, and the program can be applied to the cards without the use of a random number generator, but with the microprocessor identifying the required position for that card of particular suit and rank. The card may also be read between the off-set rollers or between the last off-set roller and the platform, although this last system will be relatively slow, as the information as to the card content will be known at such a late time that the platform cannot be appropriately moved until the information is obtained.

For example, the desired order may be a complete pack of playing cards sorted from holding means which holds a plurality of randomly oriented cards forming a plurality of packs of cards. This may be achieved by identifying the individual cards by optical readers, scanners or any other means and then under control of a computer means such as a micro-processor, placing an identified card into a specific collector means to ensure delivery of complete decks of cards in the desired order. The random number generator is used to place individual cards into random positions to ensure random delivery of one to eight or more decks of cards.

In one aspect the invention, the apparatus is adapted to provide one or more shuffled packs of cards, such as one or two decks for poker games or blackjack. According to another aspect of the invention, a method of randomizing a group of cards is accomplished using the device of the present invention. According to the invention, the method includes the steps of 1) placing a group of cards to be randomized into a card infeed tray; 2) removing cards individually from the card infeed tray and delivering the cards into a card collection area, the card collection area having a moveable lower surface, and a stationary opening for receiving cards from the infeed tray; 3) elevating the moveable lower surface to a randomly determined height; 4)

grasping at least one edge of a group of cards in the card collection area at a point just above the stationary opening; 5) lowering the moveable lower surface to create an opening in a stack of cards formed on the lower surface, the opening located just beneath a lowermost point where the cards are grasped; and 6) inserting a card removed from the infeed tray into the opening. According to the method of the present invention, steps 2 through 6 are repeated until all of the cards originally present in the infeed tray are processed, forming a randomized group of cards.

As described above, the method and apparatus of the present invention can be used to randomize groups of cards, as well as sort cards into a particular desired order. When sensing equipment is used to detect rank and suit of the cards, the cards can be arranged in any predetermined order according to the invention. It is to be understood that numerous variations of the present invention are contemplated, and the disclosure is not intended to limit the scope of the invention to the examples described above. For example, it might be advantageous to tip the card mixing area 150 slightly such that a top portion is further away from the card receiving area 106 than a bottom portion. This would assist in aligning the stack vertically in area 105 and would increase the efficiency and accuracy of the randomization or ordering process. In one preferred embodiment, the card receiving area 150 is tipped between 3 and 8 degrees from the vertical.

In another embodiment of the invention, the shuffler is mounted such that infeed tray or card receiving area 106 is recessed beneath the top surface of a gaming table, and a lower surface of the delivery area or card return area 32 in its upright position is flush with the gaming table surface.

Although the machine can sit on the table top, it is preferably mounted on a bracket having a support surface located beneath the gaming table surface, enabling a dealer to obtain and return cards without undue lifting above the surface of the gaming table. In one embodiment, the entire shuffler is mounted into the gaming table such that the infeed tray and card return areas are either flush or approximately flush with the gaming table surface. Such an arrangement would be particularly suited to conventional poker rooms.

What is claimed is:

1. A device for forming a random set of playing cards comprising:

a top surface and a bottom surface of said device;

a card receiving area for receiving an initial set of playing cards;

a randomizing system for randomizing the initial set of playing cards;

a collection surface in a card collection area for receiving randomized playing cards, the collection surface receiving cards so that all cards are received below the top surface of the device;

at least one card supporting element within the card collection area that will support a predetermined number of cards within the card collection area and separate at least a group of cards from the card supporting element to create a space between the at least a group of cards and remaining cards or the card supporting element, creating an insertion area receiving a next card to be randomized;

an insertion point to the card collection area positioned below said predetermined number of cards; and an elevator for raising the collection surface so that at least some randomized cards are elevated at least to the top surface of the device.

2. The device of claim 1 wherein the elevator raises randomized cards above the top surface of the device.

3. The device of claim 1 wherein a confining set of walls confines all randomized cards along all edges of the playing cards after the at least some randomized cards are elevated.

4. The device of claim 1 wherein the card receiving area is sloped to assist movement of playing cards towards the randomizing system.

5. The device of claim 1 wherein at least one pick-off roller removes cards one at a time from the card receiving area and moves cards one at a time towards the randomizing system.

6. The device of claim 5 wherein at least one pair of rollers receives cards from the at least one pick-off roller.

7. The device of claim 6 wherein a microprocessor controls movement of the pick-off roller and the at least one pair of rollers.

8. The device of claim 7 wherein the microprocessor is programmed to direct the pick-off roller to cease propelling a first card being moved byte pick-off roller when it is sensed that the first card is being moved by the at least one pair of rollers.

9. device of claim 6 wherein when a first card being moved by the pick-off roller is being moved by the at least one pair of rollers, movement of the pick-off roller is altered so that no card other than the first card is moved by either the pick-off roller or the at least one pair of rollers.

10. The device of claim 9 wherein tension on the first card effected by the at least one pair of rollers causes the pick-off roller to freely rotate and to not propel the first card.

11. The device of claim 9 wherein a microprocessor is controllably connected to the device, the microprocessor directing movement of playing card moving elements within the device, the microprocessor randomly assigning potential positions for each card within the initial set of playing cards, and then directing the device to arrange the initial set of playing cards into those randomly assigned potential positions to form a randomized final sot of playing cards.

12. The device of claim 1 wherein the randomization system moves one card at a time into an area overlying the collection surface.

13. The device of claim 1 wherein one card at a time is positioned into a randomized set of playing cards over the randomization surface.

14. The device of claim 13 wherein the playing surface is bordered on two opposed sides by two movable card gripping elements.

15. The device of claim 14 wherein an insertion point to the card collection area is located below a bottom edge of the two movable card gripping elements.

16. The device of claim 15 wherein a microprocessor is controllably connected to the device, the microprocessor directing movement of playing card moving elements within the device, the microprocessor randomly assigning potential positions for each card within the initial set of playing cards, and then directing the device to arrange the initial set of playing cards into those randomly assigned potential positions to form a randomized final set of playing cards.

17. The device of claim 14 wherein the card supporting surface is vertically positionable within the card collection area.

18. The device of claim 17 wherein the card supporting surface is moved by a motivator tat is able to move incremental vertical distances that are no greater than the thickness of a playing card.

19. The device of claim 17 wherein the card supporting surface is moved by a motivator that is able to move incremental vertical distances that are no greater than one-half the thickness of a playing card.

20. The device of claim 19 wherein the motivator is a step motor.

21. The device of claim 19 wherein the motivator is an analog motor.

22. The device of claim 1 wherein a sensor is present within the collection area, below the top surface of the device, the sensor detecting a position of a top card.

23. The device of claim 22 wherein a microprocessor is present in the device and the microprocessor controls vertical movement of the card supporting surface.

24. The device of claim 23 wherein the sensor identifies the position of the collection plate to place the top card at a position level with the bottom of at least one card gripping clement that is movable from at least one side of the collection area towards playing cards within the card collection area.

25. The device of claim 24 wherein the microprocessor is programmed to determine a distance that the card supporting surface must be vertically moved to position at least one specific card other than the top card at a bottom edge of the at least one card gripping element when the card gripping element moves to contact cards within the card collection area.

26. The device of claim 25 wherein the at least one card gripping element comprises at least two gripping elements that move from opposed sides of the collection area towards playing cards within the card collection area.

27. The device of claim 26 wherein the microprocessor is programmed to lower the card collection surface within the card collection area after the two elements have contacted and supported cards within the card collection area, creating two segments of cards.

28. The device of claim 27 wherein the microprocessor directs movement of an individual card into the card supporting area between the two segments of cards.

29. The device of claim 27 wherein a microprocessor is controllably connected to the device, the microprocessor directing movement of playing card moving elements within the device, the microprocessor randomly assigning potential positions for each card within the initial set of playing cards, and then directing the device to arrange the initial set of playing cards into those randomly assigned potential positions to form a randomized final set of playing cards.

30. The device of claim 25 wherein the microprocessor is programmed to lower the card collection surface within the card collection area after the at least one card gripping element has contacted and supported cards within the card collection area, creating two segments of cards.

31. The device of claim 30 wherein the microprocessor directs movement of an individual card into the card supporting area between the two segments of cards.

32. The device of claim 24 wherein a microprocessor is controllably connected to the device, the microprocessor directing movement of playing card moving elements within the device, the microprocessor randomly assigning potential positions for each card within the initial set of playing cards, and ten directing the device to arrange the initial set of playing cards into those randomly assigned potential positions to form a randomized final set of playing cards.

33. The device of claim 1 wherein a microprocessor is controllably connected to the device, the microprocessor directing movement of playing card moving elements within the device, the microprocessor randomly assigning potential positions for each card within the initial set of playing cards, and then directing the device to arrange the initial set of playing cards into those randomly assigned potential positions to form a randomized final set of playing cards.

34. A device for forming a random set of playing cards comprising:

a top surface and a bottom surface of said device;

a receiving area for an initial set of playing cards;

a randomizing system the initial set of playing cards;

a collection surface in a card collection area for receiving randomized playing cards;

an elevator for raising the collection surface within the card collection area;

at least one card supporting clement within the card collection area that will support a predetermined number of cards within the card collection area and separate at least a subgroup of cards from the randomized cards on the card collection surface; and an insertion point to the card collection area positioned below said predetermined number of cards.

35. The device of claim 34 wherein the at least one card supporting element comprises an element on at least one side of the card collection area that can move inwardly within the card collection area to contact and support the predetermined number of cards within the card collection area.

36. The device of claim 35 wherein the at least one card supporting element comprises at least two opposed card supporting elements that move inwardly within the card collection area to contact and support the predetermined number of cards within the card collection area.

37. The device of claim 36 wherein a microprocessor is communicatively connected to the device and the microprocessor is programmed to determine a distance that the card supporting surface must be vertically moved to position at least one specific card position other tan the top card at a bottom edge of the at least one card supporting element when the card supporting element moves to contact cards within the card collection area.

38. The device of claim 37 wherein a microprocessor communicatively connected to the device is programmed to lower the card collection surface within the card collection area after the at least one card supporting element has contacted and supported cards within the card collection area, creating two segments of cards.

39. The device of claim 38 wherein the microprocessor directs movement of an individual card into the card supporting area between the two segments of cards.

40. The device of claim 35 wherein a microprocessor communicatively connected to the device is programmed to lower the card collection surface within the card collection area after the at least one card supporting element has contacted and supported cards within the card collection area, creating two segments of cards.

41. The device of claim 40 wherein a microprocessor communicatively connected to the device is programmed to lower the card collection surface within the card collection area after the at least one card supporting element has contacted and supported cards within the card collection area, creating two segments of cards.

42. The device of claim 41, wherein the microprocessor directs movement of an individual card into the card supporting area between the two segments of cards.

43. The device of claim 34 wherein a microprocessor is communicatively connected to the device and the microprocessor is programmed to determine a distance that the card supporting surface must be vertically moved to position at least one specific card position other than the top card at a bottom edge of the at least one card supporting element when the card supporting element moves to contact cards within the card collection area.

44. An automatic card shuffling device comprising:

a microprocessor with memory for controlling the operation of the device;

an infeed compartment for receiving cards to be randomized;

a card moving mechanism for moving cards individually from the infeed compartment into a card mixing compartment;

a card mixing compartment comprising a plurality of substantially vertical supports, an opening for the passage of cards from the infeed compartment, a moveable lower support surface; at least one stationary gripping arm, a lower edge proximate the opening, the gripping arm capable of suspending cards above the slot, an elevator for raising and lowering the moveable support surface;

wherein a position of the elevator is randomly selected and the support surface is moved to the selected position, and after the gripping arm grasps at least one side of the cards, the elevator lowers, creating a space beneath the gripping arm, wherein a card is moved from the infeed compartment into the space, thereby randomizing the cards.

45. The automatic card shuffling device of claim 44, wherein when each card in the infeed compartment has been fed into a space created by the gripping arm and random positioning of the lower support surface, the stack of cards in the card mixing area is randomized.

46. The device of claim 44, wherein the elevator is moveable to raise the stack of shuffled cards after all cards in the infeed compartment are fed.

47. The device of claim 44, and further comprising a card delivery tray located above the moveable lower support.

48. The device of claim 47, wherein the moveable lower support defines a lower support surface of the card delivery tray.

49. The device of claim 47, wherein the card delivery fray is positioned on an upper surface of the device.

50. The device of claim 47, wherein a lower surface of the infeed tray and lower surface of the card deliver tray are positioned at an elevation proximate an elevation of a gaining table surface.

51. The method of claim 50, wherein after a card has been inserted, and when a presence of additional cards in the card infeed tray is sensed, the elevator moves to another randomly determined height, creating another opening.

52. The device of claim 51, wherein the shuffler is concealed beneath a gaming table surface.

53. The device of claim 51, wherein the shuffler is mounted to a support bracket.

54. The device of claim 51, wherein the card shuffler is built into a gaming table, and is at least partially surrounded by gaming table surface.

55. The device of claim 44, wherein two stationary gripping arms are provided to grip opposite sides of a stack of cards.

56. The device of claim 44, wherein the opening in the card mixing compartment is a horizontal slot, and wherein the infeed compartment comprises a lower surface, wherein the card moving mechanism comprises a pick off roller for moving a lowermost card in the infeed compartment toward the slot in the card mixing compartment.

57. A method of randomizing a group of cards, comprising the steps of:

placing a group of cards to be randomized into a card infeed tray;

removing cards individually from the card infeed tray and delivering the cards into a card collection area, the card collection area having a moveable lower surface, and a stationary opening for receiving cards from the infeed tray;

elevating the movable lower surface to a randomly determined height;

grasping at least one edge of a group of cards in the card collection area at a point just above the stationary opening;

lowering the moveable lower surface to create an opening in a stack of cards formed on the lower surface, the opening located just beneath a lowermost point where the cards are grasped; and inserting a card removed from the infeed tray into the opening.

58. A method of arranging a group of cards into a desired order in a computer controlled automatic card shuffler, the card shuffler comprising an infeed fray, a feed mechanism, a card arranging area, a retaining device for suspending cards in the card shuffling area, a lower support surface in the card arranging area and an elevator for raising and lowering the lower support surface, the method comprising:

assigning each card in the infeed tray a final order;

feeding each card individually into the card arranging area, wherein the lower support surface is lowered beneath an elevation of the card feed mechanism when the computer instructs that the card being fed is to be placed on top of the stack, suspending all cards in the card shuffling area by means of the retaining device when the computer instructs that the card being fed is to be placed on the bottom of the stack, and instructing the elevator to move, causing the lower surface to adjust to a preselected elevation, retaining a subgroup of cards above a feed elevation and lowering the lower surface, creating an opening, and placing a card between the subgroup of suspended cards and the remaining cards supported by the lower support surface.

59. The method of claim 54, wherein the final order is random.

60. The method of claim 54, wherein the final order is predetermined.

61. The method of claim 60, wherein the final order is an original playing card pack order.

62. The method of claim 54 and further comprising the step of reading a suit and rank of each card prior to feeding the cards into the card arranging area.

63. A device for forming a random set of playing cards comprising:

a top surface and a bottom surface of said device;

a card receiving area for receiving an initial set of playing cards;

a randomizing system for randomizing the initial set of playing cards;

a collection surface in a card collection area, the collection surface supporting and receiving all randomized playing cards, the collection surface receiving cards so that all cards are received below the top surface of the device;

at least one card supporting element within the card collection area that will support a predetermined number of cards within the card collection area and separate at least a group of cards from the card supporting element to create a space between the at least a noun of cards and remaining cards or the card supporting element for random insertion of individual cards; and an elevator for raising the collection surface so that at least some randomized cards are elevated at least to the top surface of the device.

64. The device of claim 63 wherein the elevator raises all randomized cards above the top surface of the device.

65. The device of claim 63 wherein a single stack of cards is supported on the collection surface, a top section of a subgroup of cards is separated from the single stack of cards to form two subgroups of cards with an opening between the two subgroups of cards, and a single card is inserted in said opening.

66. The device of claim 65 wherein a pair of grippers supports said top section of a subgroup of cards.

67. The device of claim 63 wherein a random number generator assigns a random position number to each card within the initial set of cards.

68. The device of claim 67 wherein the random position number determines a randomly determined position that each card will occupy in the randomized playing cards.

69. The device of claim 68 wherein a microprocessor identifies each card by an original position number within the initial set of cards, the microprocessor uses the random position number to direct the elevator to move into position where each card can be properly inserted into a randomized or shuffled set of cards.

* * * * *

UNITED STATES PATENT AND TRADEMARK OFFICE

CERTIFICATE OF CORRECTION

PATENT NO. : 6,651,981 B2 
DATED : November 25, 2003
INVENTOR(S) : Attila Grauzer et al.

It is certified that error appears in the above-identified patent and that said Letters Patent is hereby corrected as shown below:

Column 21,
Line 2, please replace "… at least a noun of " and please insert -- …at least a group of --

Signed and Sealed this

Twenty-fifth Day of May, 2004

JON W. DUDAS
*Acting Director of the United States Patent and Trademark Office*